United States Patent [19]

Carr

[11] Patent Number: 4,871,120

[45] Date of Patent: Oct. 3, 1989

[54] GUIDE DEVICE FOR TOOTHED ROLL SHREDDER

[76] Inventor: Harold B. Carr, 311 Lloyd St., Akron, Ohio 44301

[21] Appl. No.: 304,767

[22] Filed: Jan. 31, 1989

Related U.S. Application Data

[63] Continuation of Ser. No. 161,497, Feb. 29, 1988, abandoned.

[51] Int. Cl.[4] ..... B02C 23/02

[52] U.S. Cl. ..... 241/224; 241/101.2; 241/222

[58] Field of Search ..... 198/836; 193/25 R; 222/527; 241/101.2, 186 R, 186.2, 186.3, 222, 224, 245, 248

[56] References Cited

U.S. PATENT DOCUMENTS 1,298,561 3/1919 Powell ..... 241/224 X
2,821,433 1/1958 Hamlet ..... 193/25 R

FOREIGN PATENT DOCUMENTS 13159 of 1911 United Kingdom ..... 241/222 X

*Primary Examiner*—Joseph M. Gorski
*Attorney, Agent, or Firm*—Reese Taylor

[57] ABSTRACT

A device for vertically guiding articles into a toothed roll shredder, having opposing arm members and allowing articulation of the arm members in one direction to allow freedom of movement of material exiting the shredder during reverse rotation. Articulation is restricted in the opposite direction in order to ensure proper vertical alignment of the entering article.

7 Claims, 2 Drawing Sheets

GUIDE DEVICE FOR TOOTHED ROLL SHREDDER

This application is a continuation of application Ser. No. 161,497 filed Feb. 29, 1988, now abandoned.

BACKGROUND OF THE INVENTION

This invention relates, in general, to a toothed roll shredder and relates, in particular, to a guide device for vertically aligning articles, such as tires, for entry into such a shredder. The invention also relates to such a device which is rigid in one direction so as to correctly position a tire, while allowing articulation in the opposite direction so as not to restrict movement of material exiting the shredder during reverse rotation.

DESCRIPTION OF THE PRIOR ART

A roll shredder, as commonly known in the art, generally consists of two cylindrical rolls rotating toward each other. Each roll consists of a series of toothed or bladed plates rotating about the central axis of the roll. The plates of the two rolls may often overlap. A tire, or similar article, is fed into the shredder by an infeed conveyor and chute, caught by the teeth of the spinning rolls, drawn in between them and shredded by being cut by the teeth and crushed between the rolls, following which the shredded material may be removed by an offload conveyor.

Such shredders are used for reducing bulk waste materials to particulate form for disposal or recycling. In that regard, the present invention is disclosed and described herein with particular reference to pneumatic tire casings, but it will be apparent that the inventive concept may have applicability to the shredding of other materials as well It is important to proper shredder operation that the tire be initially contacted vertically on its tread, presenting a small enough dimension that the teeth of the shredder may efficiently bite into the tire. If the tire enters the shredder on its sidewall, the teeth will not be able to properly grasp the tire and draw it inward. It is often the case that the tire merely bounces along the spinning teeth without being caught and devoured by them. To solve this problem, it has been known in the art to provide a guide to position a tire vertically for entry into the teeth.

In the past, however, such guide devices have been rigid and static. Further, roll shredders are often designed to reverse the direction of rotation if a jam occurs which the shredder cannot break its way through. By reversing itself, the material causing the jam is pushed back the way it entered, clearing the jam. If the tire shredder is using a static guide device, and the rolls reverse themselves to clear a jam, it often proves the case that the material exiting the shredder engages the guide device, causing another jam or even damaging the guide device. To clear this second jam, it becomes necessary for the operator to reach down into the shredder and under the guide device to grasp the offending material. This is a dangerous maneuver at best, as it brings the operator into almost direct contact with the toothed rolls of the shredder.

Illustrative of a tire shredder employing a static guide device is U.S. Pat. No. 3,656,697 to Nelson. Although this type of guide device is presumably effective during normal shredding operation, it possesses the disadvantageous quality of not allowing material to freely exit the shredder during jam clearing reverse rotation.

U.S. Pat. No. 4,052,013 to Ehrlich et al discloses a shredder having a hopper-type static guide which suffers from the same drawbacks as all shredders employing static guides.

U.S. Pat. No. 3,931,935 to Holman provides an example of a tire shredder having rolls made up of a series of toothed plates wherein the plates of the two rolls intermesh. Further examples of toothed roll shredders are provided by U.S. Pat. No. 4,142,688 to Johnson et al, U.S. Pat. No. 4,374,573 to Rouse et al, and U.S. Pat. No. 4,607,800 to Barclay.

Another type of rigid guide is disclosed in U.S. Pat. No. 4,519,550 to Rouse. It provides a plurality of guide-clearer fingers which are spaced between the individual plates of each roll. The fingers are not selectively articulated and are, therefore, subject to jamming during reverse rotation.

It is, therefore, a primary object of the present invention to provide a guide device for a toothed roll shredder which does not suffer from the disadvantages of the heretofore existing guide devices.

SUMMARY OF THE INVENTION

It has been found that the aforementioned object can be achieved by providing a series of opposing, articulated arm members along the length of a toothed roll shredder. Each arm member is rigid in one direction so as to align a tire into vertical position such that the treads of the tire engage the rolls of the shredder, and not the sidewall of the tire.

It has also been found that the aforementioned object can be achieved by providing that each guide device arm member is also articulated so as to allow movement in a direction opposite to the member's rigidity. This alleviates the problem with previous static guide devices which hinder material exiting the shredder during reverse rotation. With the present invention, when a shredder reverses its rotation and expels material back toward the guide device, the arm members are merely caused to pivot by the engaging material at the articulation points, allowing the material to freely escape the shredder. At no time is it necessary for an operator to be in close proximity to the rolls of the shredder.

It has further been found that this feature may be further enhanced by mounting one end of each of the articulated arm members to a rod which is disposed above the rolls of the shredder, extends in the same direction as the axis of the rolls and is itself pivotally mounted. This type mounting further facilitates movement of the arms upon contact with the engaging material.

Once the shredder resumes normal shredding rotation and material is once again drawn into the shredder, the articulated guide device arm members return to their unarticulated position due to the force of gravity. Again, an operator is never required to approach the shredder.

Accordingly, production of an improved guide device for a toothed roll shredder of the character above-described becomes the principal object of this invention with other objects becoming more apparent upon a reading of the following brief specification considered and interpreted in view of the accompanying drawings.

DESCRIPTION OF THE PREFERRED EMBODIMENTS

It will first be noted that the present invention is directed towards a device for guiding tires, or similar articles, in a vertical position into a toothed roll shredder. In particular, the present invention is directed towards a guide device being rigid in one direction so as to facilitate vertical positioning of a tire, while being articulated in the opposite direction to allow free movement of material exiting the shredder during reverse rotation. It is understood that the guide device specifically described herein is but one device of many which may embody the spirit of the invention.

Figure 1:
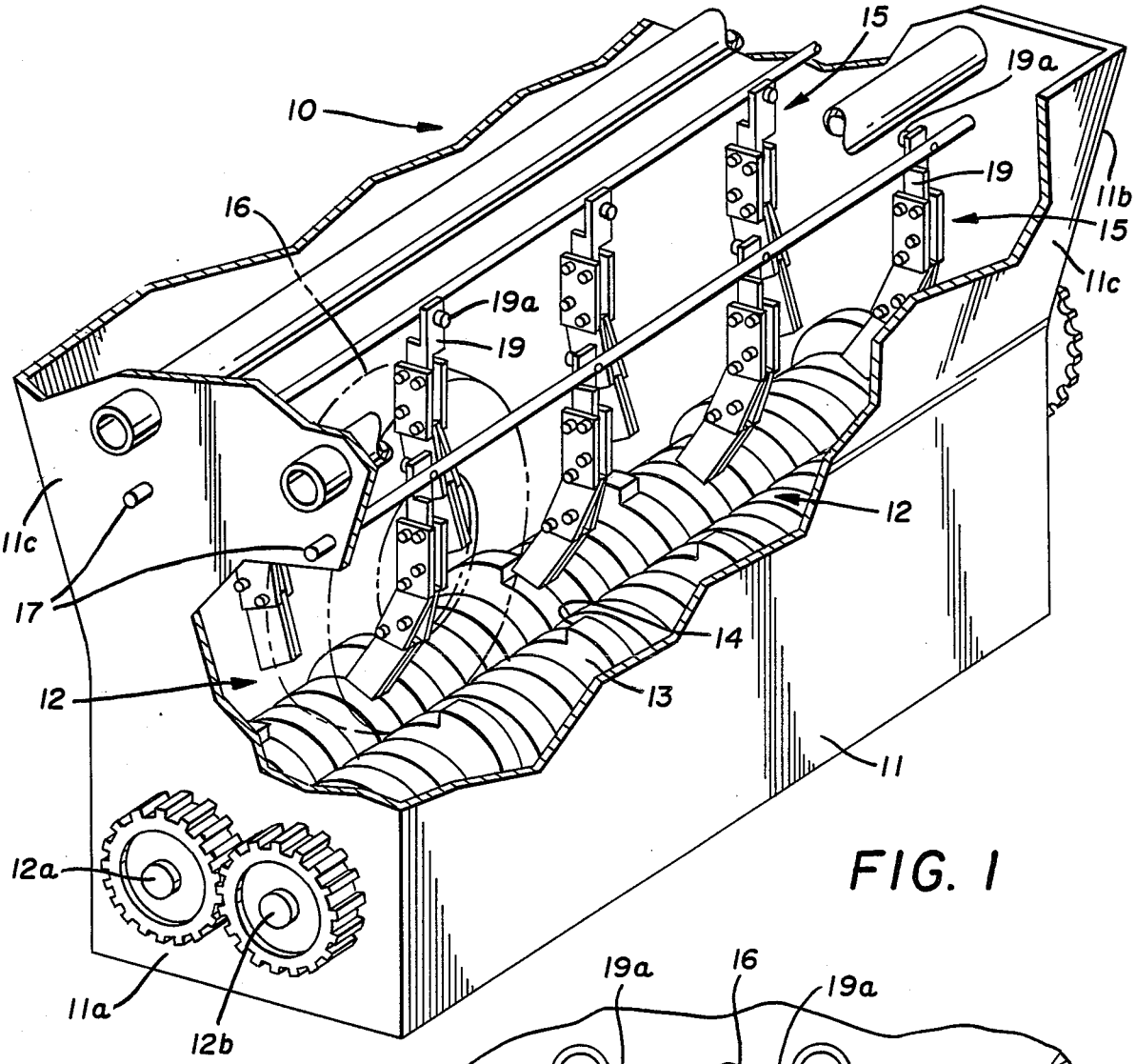
FIG. 1 is a perspective view of a toothed roll shredder employing a guide device embodying the concept of the present invention.
Figure 2:
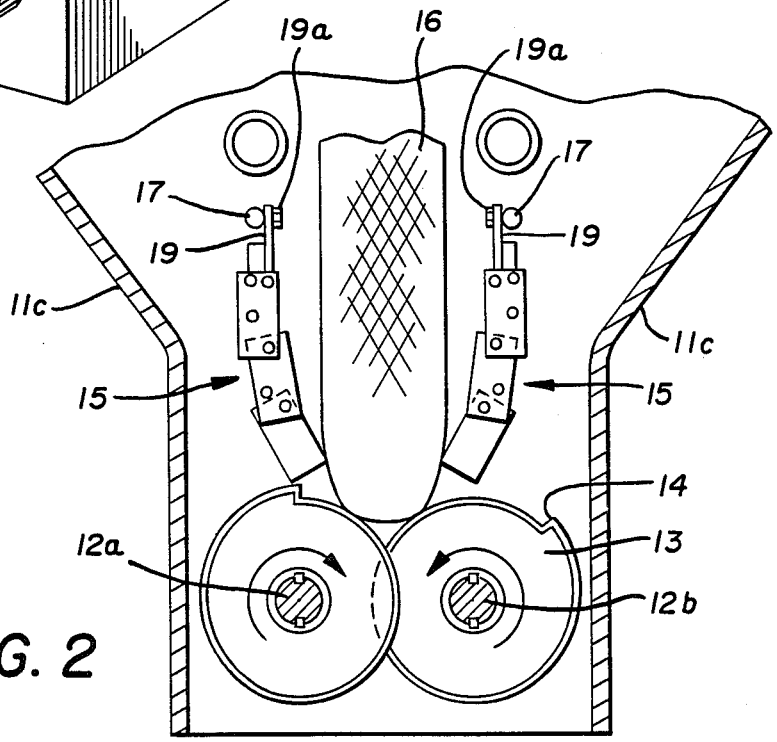
FIG. 2 is a cross-section of the roll shredder of FIG. 1, taken along a line substantially perpendicular to the axes of the two rolls and showing two members of the guide device.

FIG. 1 presents a toothed roll tire shredder, generally indicated by the numeral 10, employing a guide device consisting of a series of opposing arm members 15 positioned along the length of the shredder 10. The shredder 10 has two rolls, generally indicated by the numeral 12, mounted in a housing 11 which has opposed end walls 11*a* and 11*b* and a chute-like top 11*c*. Each roll has a series of toothed plates or knives 13 with teeth 14 projecting therefrom. Shown by phantom lines in FIG. 1 is a tire 16 held in a vertical position by opposing arm members 15. FIG. 2 also shows tire 16 engaged by opposing arm members 15.

As is known in the art, the shafts 12*a*,12*b* of the rolls 12 are journalled in the ends 11*a* and 11*b* of the housing 11 and include a drive shaft and a driven shaft such that the gear on the drive shaft engages the gear on the driven shaft to rotate the rolls and the knives, as illustrated by the arrows in FIG. 2 of the drawings.

It will be understood that details of the motor, transmission, belt drives and gear box have been omitted herein since such structure is well-known in the art.

With that in mind, as previously noted, the tire 16 will be fed into the shredder by an infeed conveyor and chute (not shown), and the shredder material will be removed through the bottom of housing 11 by an outfeed conveyor (also not shown). This apparatus has not been illustrated herein or described in detail since it is well within the knowledge of those of ordinary skill in the art. Such apparatus can, for example, be seen in the aforementioned Nelson and Ehrlich patents.

Figure 3:
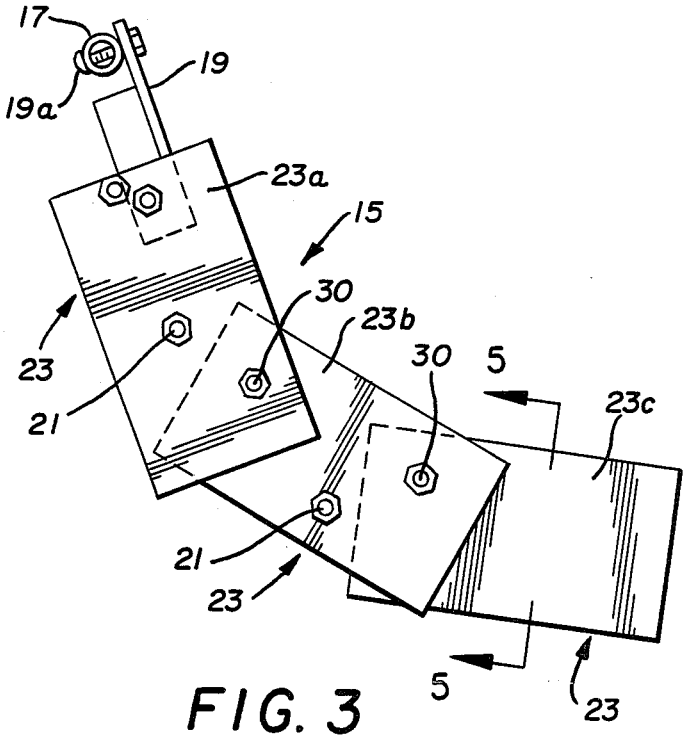
FIG. 3 is a side elevational view of one member of the guide device of FIG. 1, showing the member in articulated position.

One embodiment of arm member 15, shown in the accompanying drawings, consists of a plurality of at least two segments 23 articulated with respect to each other. FIG. 3 shows an arm member 15 having a series of three such segments 23*a*, 23*b* and 23*c*.

Figure 5:
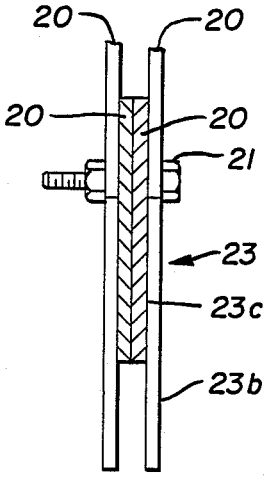
FIG. 5 is a front elevational view of the guide device member, taken substantially along the line 5—5 in FIG. 3.
Figure 6:
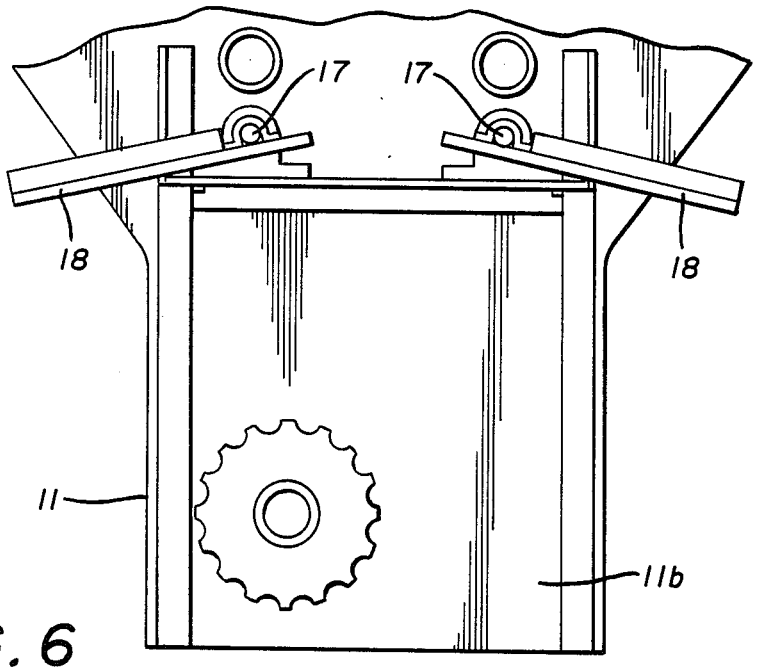
FIG. 6 is a partial end elevational view taken from the right hand end of FIG. 1.

Each segment 23 may consist of two essentially rectangular plates 20 spaced apart a predetermined distance by at least one connector pin 21 (FIG. 5). Connector pin 21 may be an ordinary nut and bolt. Plates 20 of a segment 23 are spaced apart a distance sufficient to allow a succeeding segment 23 to fit between them. For instance, in FIG. 3, the plates 20 of segment 23*a* would be sufficiently spaced to accept segment 23*b*. In turn, the plates 20 of segment 23*b* would be sufficiently spaced to accept segment 23*c* which is the cross-section shown in FIG. 5. In the embodiment shown in the drawings, segment 23*c* represents the last segment of arm member 11 and, therefore, need not comprise spaced plates and can be a single piece of material.

It is to be understood that the configuration of arm member 15 just described is only one of many possible embodiments which would embrace the spirit of the invention. Segments 23 made up of single plates 20 articulated between themselves would be another example of the present invention.

Two succeeding segments 23 are pivotally secured together by a joint pin 30, as shown between segments 23*a* and 23*b* and between segments 23*b* and 23*c* in FIG. 3. Joint pin 30 may in actuality be the same type of pin as connector pin 21. By being the only point wherein two succeeding segments 23 are connected, and by spacing plates 20 just far enough to accept a subsequent segment 23, the two segments are free to pivot around joint pin 30 and to articulate with respect to each other.

During reverse rotation of the tire shredder 10, when material exits the shredder towards the arm members 15, the material may engage the arm members, pivoting individual segments 23 around joint pins 30 and away from rolls 13,13. In this way, arm members 15 are pushed out of the way by the exiting material. The material, thus, does not jam between the arm members 15 and the shredder 10, as may happen with a static guide device.

This feature is further enhanced by the method of mounting the arms 15 on housing 11. It will be noted from FIG. 1 that elongate rods 17,17 extend from one end 11*a* of housing 11 to the other end 11*b*. These rods are mounted so that they may pivot about their longitudinal axes. Thus, at the end 11*a*, they are simply received through apertures in the end wall and, at end 11*b*, they pass through the end wall and are attached to balance arms 18,18.

These arms 18,18 are connected to suitable limit switches (not shown) which, upon suitable movement of the arms, will reverse the rolls.

Secured to rods 17,17 at spaced intervals is one end of each segment 23*a* of each arm 15. This attachment can be accomplished many ways, such as by pins 19*a*,19*a*. In any event, the rods 17,17 can, in this fashion, be pivoted about their longitudinal axes in response to movement of segments 23*a*.

Figure 4:
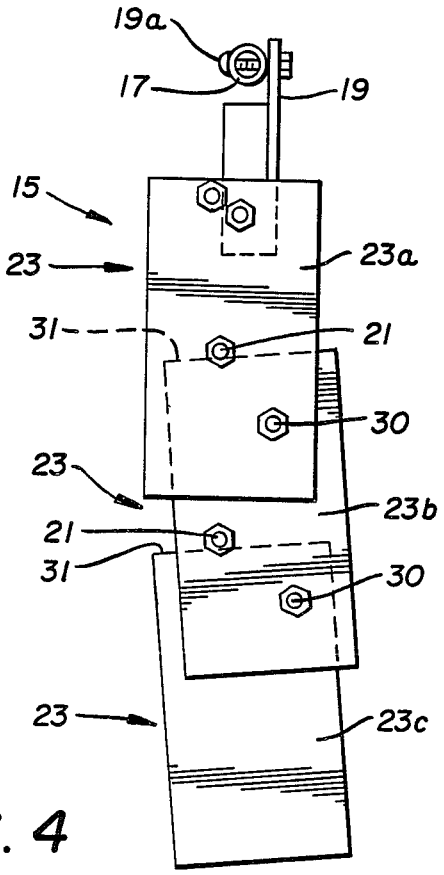
FIG. 4 is a side elevational view of the guide device member of FIG. 3, showing the member in an unarticulated position.

In order to properly align tires 16 for vertical entry into the shredder 10, it is necessary that the arm members 15 be prevented from articulating in a direction toward rolls 12. That is, the arm members 15 must be rigid in one direction so that they engage the tire, forcing it into a vertical position. As best shown in FIG. 4, articulation restriction of an arm member 15 may be accomplished by a strategic positioning of connector pin 21 in relation to first segment 23*a*, second segment 23*b* and joint pin 30.

Thus, connector pin 21 may be positioned so as to engage leading edge 31 of segment 23*b* when segment 23*b* has reached a position where rigidity of arm member 11 is desired.

The placement of connector pin 21 and the subsequent angle between succeeding segments 23 is a matter of choice and is generally dependent upon the dimensions of the tires to be shredded and the requirements of the shredder itself. It is to be understood that a device employing a stop block or other means of restricting pivoting around joint pin 30 would embody the spirit of the invention.

While many tire shredders will operate most efficiently with tires entering vertically, it may be envisioned that some shredders will be most efficient when the tire enters at some angle. The arm members 15 of the present invention may be adjusted so as to accomplish tire entry at such an angle. Connector pins 21 of one arm member 15 may be positioned so that there is some angle between succeeding segments 23, while the opposing arm member 15 may be configured with segments 23 having greater, lesser or no angles between them. A tire engaging a guide device with such a construction will enter the shredder at an angle. This, too, would embody the spirit of the present invention.

While a full and complete description of the invention has been set forth in accordance with the dictates of the Patent Statutes, it should be understood that modifications can be resorted to without departing from the spirit hereof or the scope of the appended claims.

In that regard, it should again be noted that while reference throughout has been made to a tire, the invention is not intended to be so limited and the guide device may have utility with respect to other articles as well.

What is claimed is:

1. In a toothed roll shredder, a device for aligning articles for entry into opposed and intersecting shredding rolls and a housing, comprising:

(a) at least two arm members positioned in opposition to each other above the shredding rolls and hingedly mounted with respect to the housing for pivotal movement about an axis parallel to the axis of rotation of the shredding rolls;

(b) said arm members mounted transversely and extending to a point adjacent to a plane wherein the rolls of the shredder intersect;

(c) each of said arm members having at least two segments hingedly connected to each other by a joint with said segments also being hingedly mounted with respect to said housing; and (d) means carried by said segments for limiting movement of said segments around said joint.

2. The device of claim 1, wherein a mounting flange is attached to one end of each said arm members.

3. The device of claim 1, wherein at least two of said segments comprise two plates held apart at a predetermined distance by at least one connector pin.

4. The device of claim 3, wherein said plates of a first of said segments receive a second said segment therebetween.

5. The device of claim 4, wherein said joint comprises one of said at least one connector pin.

6. The device of claim 1, wherein said means for limiting movement around said joint comprises a connector pin of said first segment disposed so as to selectively engage an edge of said second segment, whereby movement of said edge beyond said connector pin is prevented.

7. The apparatus of claim 1 wherein said housing includes opposed side walls and opposed end walls; a pair of elongate rods are pivotally connected to said end walls and span the distance therebetween; and said arms are attached to said rods.

* * * * *